US006018922A

United States Patent [19]

McKinnon

[11] Patent Number: 6,018,922

[45] Date of Patent: Feb. 1, 2000

[54] MOUNTING FOR ATTACHING A FACING MATERIAL TO A WALL

[76] Inventor: Gordon McKinnon, 119 S. Oregon Ave., Tampa, Fla. 33606

[21] Appl. No.: 08/897,559

[22] Filed: Jul. 21, 1997

Related U.S. Application Data

[63] Continuation of application No. 08/581,366, Dec. 29, 1995, abandoned.

[51] Int. Cl.[7] ..... E04B 2/38

[52] U.S. Cl. ..... 52/700; 52/309.2; 52/309.7; 52/309.12; 52/309.16; 52/604; 52/605; 52/607; 52/699; 52/371; 52/376; 52/439; 52/742.14

[58] Field of Search ..... 52/699, 700, 701, 52/602, 604, 605, 606, 607, 309.2, 309.7, 309.12, 309.16, 309.17, 742.14, 745.1, 733.2, 376, 375, 374, 373, 372, 371, 421, 425, 426, 431, 439, 592.3, 592.5, 592.6

[56] References Cited

U.S. PATENT DOCUMENTS

| | | | |
|---|---|---|---|
| 751,346 | 2/1904 | Schall | 52/602 X |
| 785,296 | 3/1905 | Dunn | 52/607 |
| 791,380 | 5/1905 | Thompson | 52/368 X |
| 931,616 | 8/1909 | Johanning | 52/368 X |
| 958,619 | 5/1910 | Frazier | 52/368 X |
| 960,740 | 6/1910 | Vaughan | 52/605 X |
| 1,310,220 | 7/1919 | Taylor | 52/213 X |
| 1,401,624 | 12/1921 | McEwen | 52/602 X |
| 1,649,909 | 11/1927 | McKeon | 52/368 X |
| 1,651,893 | 12/1927 | Jorgensen | 52/602 X |
| 1,938,161 | 12/1933 | Whitacre | 52/375 |
| 2,049,907 | 8/1936 | Hess | 52/375 |
| 2,741,908 | 4/1956 | Swanson | 52/602 X |
| 3,200,549 | 8/1965 | Cripe | 52/376 |
| 3,353,315 | 11/1967 | Barker | 52/605 X |
| 3,782,049 | 1/1974 | Sachs | 52/592.6 X |
| 4,573,301 | 3/1986 | Wilkinson | 52/607 |
| 4,584,807 | 4/1986 | Bear | 52/375 X |
| 4,967,528 | 11/1990 | Doran | 52/309.12 |
| 5,086,600 | 2/1992 | Holland et al. | 52/309.12 X |
| 5,123,222 | 6/1992 | Guarriello et al. | 52/309.12 |
| 5,454,199 | 10/1995 | Blom et al. | 52/309.17 X |
| 5,459,971 | 10/1995 | Sparkman | 52/426 |
| 5,465,542 | 11/1995 | Terry | 52/309.16 X |

FOREIGN PATENT DOCUMENTS

| | | | |
|---|---|---|---|
| 151293 | 10/1951 | Australia . | |
| 240013 | 5/1965 | Australia | 52/607 |
| 2427542 | 12/1975 | Germany | 52/607 |
| 2452373 | 5/1976 | Germany | 52/605 |
| 2424 | 9/1861 | United Kingdom | 52/375 |

OTHER PUBLICATIONS

VanderWerf and Munsell, "Insulating Concrete Forms Construction Manual, Successful Methods & Techniques", Copyright by Portland Cement Association, Published by The McGraw–Hill Companies, Inc., 1996.

*Primary Examiner*—Laura A. Callo
*Attorney, Agent, or Firm*—Frijouf, Rust & Pyle, P.A.

[57] ABSTRACT

An improved mounting for attaching a facing material to a wall. The wall comprises a plurality of interlocking foam blocks with each of the plurality of interlocking foam blocks having an inner and an outer block surface for defining an inner and outer wall surface. Each of the plurality of interlocking foam blocks has a vertical aperture being filled with a curable material. A plurality of grooves are defined in the one of the inner and outer block surface of each of the plurality of interlocking blocks. The plurality of grooves are aligned with the plurality of grooves in an adjacent layer for providing a plurality of continuous wall grooves. A plurality of mounting strips are insertable within the plurality of continuous wall grooves. Fastening devices fix the plurality of mounting strip within the plurality of continuous wall grooves to provide a mounting for attaching the facing material to the wall.

20 Claims, 11 Drawing Sheets

PRIOR ART

MOUNTING FOR ATTACHING A FACING MATERIAL TO A WALL

This application is a continuation of application Ser. No. 08/581,366 filed Dec. 29, 1995 now abandoned, the disclosure of which is incorporated herein by reference.

BACKGROUND OF THE INVENTION

1. Field of the Invention

This invention relates to foam building blocks and the like and more particularly to an improved apparatus and method of making a foam building block capable of readily mounting an outer and/or an inner facing material to the foam building blocks.

2. Background of the Invention

In recent years, the prior has seen an increased use of interlocking foam blocks for the construction of a building structure. A plurality of interlocking foam blocks are assembled to form a wall. Each of the plurality of interlocking foam blocks has a vertical aperture. Reinforcing steel bar was located between the plurality of interlocking foam blocks as well as being located with the vertical aperture of each of the plurality of interlocking foam blocks. The vertical aperture of each of the plurality of interlocking foam blocks are filled with a curable material such as a cementitious material or the like. Upon curing of the curable material, the building structure consisting of a reinforced cementitious material located within the vertical aperture of each of the plurality of interlocking foam blocks.

Australian Patent 151,293 to Peter Lewis Bruning discloses a wall structure comprising a number of pillars, spaced apart and tied together by top and bottom horizontal members to afford an openwork frame, and pre-cast concrete walling slabs which rest one upon another and fill in the spaces between the pillars, characterized in that the pillars are formed with inwardly presented longitudinal rebates, that the ends of the walling slabs are formed with outwardly presented rebates to afford end flanges which are received in the pillar rebates and bear against the inwardly presented faces thereof, and that the walling slabs are retained in assembled relation one upon another by wooden or other strips which are secured to the innermost faces of the pillars and overlap the end flanges of the walling slabs.

U.S. Pat. No. 791,380 to Albert A. Thompson discloses a fence-post of plastic material having embedded in a face thereof a longitudinal strip flush with the face of the post, said strip having a longitudinal groove in its rear face having converging sides which meet, said groove receiving a portion of the material of the body of the post, in the form of a longitudinal ridge standing directly in the rear of the front face of the strip and in position to receive against its side faces the ends respectively of a staple driven through the strip.

U.S. Pat. No. 931,616 to H. H. Johanning discloses a cementitious post having a slotted channel in the face of the upper portion and an air chamber formed in the lower portion thereof, a strip filling said channel, wire netting embedded in the post throughout the extent thereof, said netting being located near the surface of the post with its longitudinal edges spaced apart and turned back at acute angles, all substantially as shown and described.

U.S. Pat. No. 958,619 to L. F. Frazier discloses a fence post consisting of a concrete base having a surface area greater than the post. A core rising centrally from and integral with said base, and exterior tile enclosing said core and extending from the top of the post downwardly to and into the concrete base. The said tile having one face recessed and a wooden strip secured in said recess.

U.S. Pat. No. 1,649,909 to T. F. McKeon discloses a concrete fence post comprising a main body portion; a pair of longitudinally extending spaced reinforcing strips, of a width slightly less than the thickness of said post, embedded in said post and having their longitudinal edges within the marginal limits of said post; U-shaped clips for embracing said strips at their longitudinal edges for retaining the same in operative relative position, the outer ends of said U-shaped clips being flared outwardly for preventing their removal from the concrete poured around said strips; a wooden strip embedded in said main body portion between said reinforcing strips and having its inner face projecting inwardly of one of the longitudinal edges of said strips, the outer face of said wooden strip lying flush with one of the faces of said post; U-shaped clips embedded in said post, the legs of said U-shaped clips engaging opposite faces of said wooden strip in said post and the bight of said U-shaped shaped clips lying snugly in engagement with the outer surface of said wooden strip, the ends of said legs of said U-shaped clips being angularly turned for preventing their removal from said post.

Although the use of interlocking foam blocks for the construction of a building structure has increase the efficiency of the construction of a building structure, the use of interlocking foam blocks of the prior art has certain disadvantages. A significant disadvantage of the interlocking foam blocks of the prior art is the difficulty of affixing an outer and/or an inner facing material to the foam building blocks.

Therefore it is an object of this invention to provide an improved mounting for attaching a facing material to a wall having a plurality of mounting strips secured within the plurality of continuous wall grooves to provide a mounting for attaching the facing material to the wall.

Another object of this invention is to provide an improved mounting for attaching a facing material to a wall including an improved mounting for attaching an inner facing material to an inner wall surface and/or for attaching an outer facing material to an outer wall surface.

Another object of this invention is to provide an improved mounting for attaching a facing material to a wall incorporating a plurality of trapezoidal cross-section with a minor base of the trapezoidal cross-section being disposed in alignment with the block surface of each of the plurality of interlocking blocks. Each of the plurality of mounting strips comprises a first and second mounting strip with the first mounting strip having a triangular cross section being insertable within the plurality of continuous wall grooves and with the second mounting strip having rhomboidal cross-section being inserted within the plurality of continuous wall grooves adjacent to the first mounting strip for substantially filling the plurality of continuous wall grooves.

Another object of this invention is to provide an improved mounting for attaching a facing material to a wall including fastening means for fixing the triangular cross-section mounting strip to the rhomboidal cross-section mounting strip to interlock the triangular and rhomboidal mounting strips within the continuous wall groove to provide a mounting for attaching the facing material to the wall.

Another object of this invention is to provide an improved mounting for attaching a facing material to a wall including mechanical fasteners for fixing the triangular cross-section mounting strip to the rhomboidal cross-section mounting strip to interlock the triangular and rhomboidal mounting strips within the continuous wall groove to provide a mounting for attaching the facing material to the wall.

Another object of this invention is to provide an improved mounting for attaching a facing material to a wall including mechanical fasteners extending into the vertical aperture of each of the plurality of interlocking foam blocks for being retained by the curable material filled within the vertical aperture of each of the plurality of interlocking foam blocks.

Another object of this invention is to provide an improved mounting for attaching a facing material to a wall including an adhesive for fixing the plurality of mounting strip within the plurality of continuous wall grooves.

Another object of this invention is to provide an improved mounting for attaching a facing material to a wall including preforming the plurality of grooves in each of the plurality of interlocking blocks.

Another object of this invention is to provide an improved mounting for attaching a facing material to a wall including cutting the plurality of grooves in each of the plurality of interlocking blocks after the plurality of interlocking foam blocks are formed into the wall.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved mounting for attaching a facing material to a wall. The wall comprises a plurality of interlocking foam blocks with each of the plurality of interlocking foam blocks having an inner and an outer block surface for defining an inner and outer wall surface. Each of the plurality of interlocking foam blocks has a vertical aperture being filled with a curable material. A plurality of grooves are defined in the one of the inner and outer block surface of each of the plurality of interlocking blocks. The plurality of grooves are aligned with the plurality of grooves in an adjacent layer for providing a plurality of continuous wall grooves. A plurality of mounting strips are insertable within the plurality of continuous wall grooves. Fastening means fix the plurality of mounting strip within the plurality of continuous wall grooves to provide a mounting for attaching the facing material to the wall.

In a more specific embodiment of the invention, each of the plurality of foam block includes a first and a second end surface, a top surface and a bottom surface. Each of the vertical apertures extends between the top surface and the bottom surface for enabling the curable material to fill the multiple layers of the plurality of interlocking foam blocks. The curable material fills the vertical apertures of the plurality of foam block includes a cementitious material. In one embodiment of the invention, each of the plurality of mounting strips comprises a wood furring strip.

In another embodiment of the invention, each of the plurality of grooves has a trapezoidal cross-section with a minor base of the trapezoidal cross-section being disposed in alignment with the block surface of each of the plurality of interlocking blocks. Each of the plurality of mounting strips comprises a first and second mounting strip. The first mounting strip has a triangular cross section being insertable within the plurality of continuous wall grooves. The second mounting strip has a rhomboidal cross-section being inserted within the plurality of continuous wall grooves adjacent to the first mounting strip for substantially filling the plurality of continuous wall grooves.

In one embodiment of the invention, the fastening means fixes the triangular cross-section mounting strip to the rhomboidal cross-section mounting strip to interlock the triangular and rhomboidal mounting strips within the continuous wall groove. In another embodiment of the invention, the fastening means includes a mechanical fastener for fixing the triangular cross-section mounting strip to the rhomboidal cross-section mounting strip to interlock the triangular and rhomboidal mounting strips within the continuous wall groove. Preferably, the mechanical fasteners extend into the vertical aperture of each of the plurality of interlocking foam blocks for being retained by the curable material filled within the vertical aperture of each of the plurality of interlocking foam blocks. In still another embodiment of the invention, the fastening means comprises an adhesive for fixing the plurality of mounting strip within the plurality of continuous wall grooves.

The invention is also included into the method of attaching a facing material to a wall. The wall comprises a plurality of interlocking foam blocks with each of the plurality of interlocking foam blocks having an inner and an outer block surface for defining an inner and outer wall surface. Each of the plurality of interlocking foam blocks having a vertical aperture being filled with a curable material. The method comprises forming a plurality of grooves defined in the one of the inner and outer block surface of each of the plurality of interlocking blocks for providing a plurality of continuous wall grooves. A plurality of mounting strips are inserted within the plurality of continuous wall grooves and the plurality of mounting strip are fastened within the plurality of continuous wall grooves to provide a mounting for attaching the facing material to the wall.

In a more specific embodiment of the invention, the step of forming a plurality of grooves defined in the block surface includes preforming the plurality of grooves in each of the plurality of interlocking blocks. In an alternate form of the invention, the step of forming a plurality of grooves defined in the block surface includes cutting the plurality of grooves in each of the plurality of interlocking blocks after the plurality of interlocking foam blocks are formed into the wall.

In another embodiment of the invention, the step of forming a plurality of grooves includes forming a plurality of grooves having a trapezoidal cross-section with a minor base of the trapezoidal cross-section being disposed in alignment with the block surface of each of the plurality of interlocking blocks. A plurality of first mounting strips having a triangular cross section are inserted within the plurality of continuous wall grooves. A plurality of second mounting strips having a rhomboidal cross-section are inserted within the plurality of continuous wall grooves adjacent to the first mounting strip for substantially filling the plurality of continuous wall grooves.

The step of fastening the plurality of mounting strip within the plurality of continuous wall grooves may include inserting a plurality of mechanical fastener for fixing the mounting strip within the plurality of continuous wall grooves. In the alternative, the step of fastening the plurality of mounting strip within the plurality of continuous wall grooves may include an adhesive for fixing the plurality of mounting strip within the plurality of continuous wall grooves.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
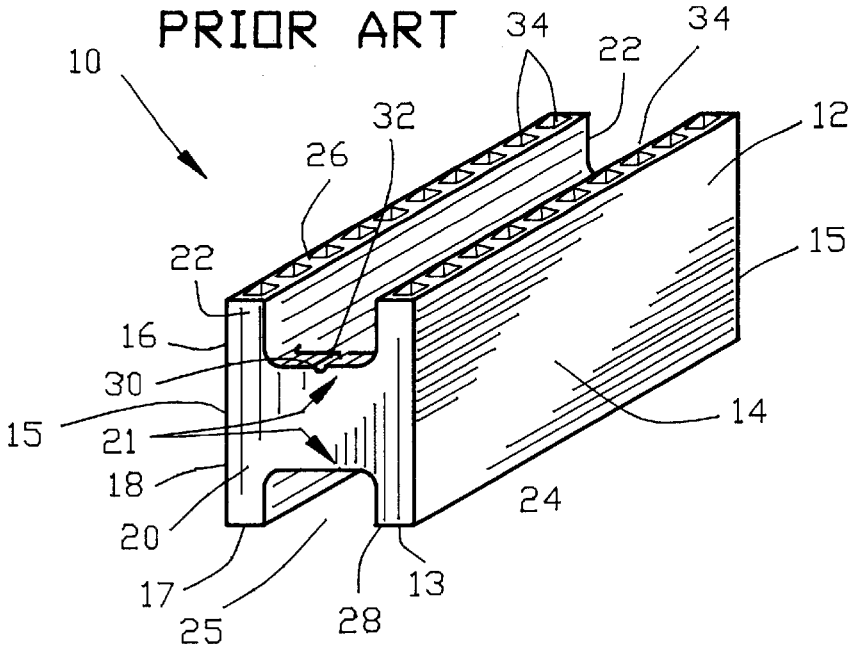
FIG. 1 is an isometric view of an interlocking block as used in the prior art illustrating a top surface, a face surface and a first end surface.
Figure 2:
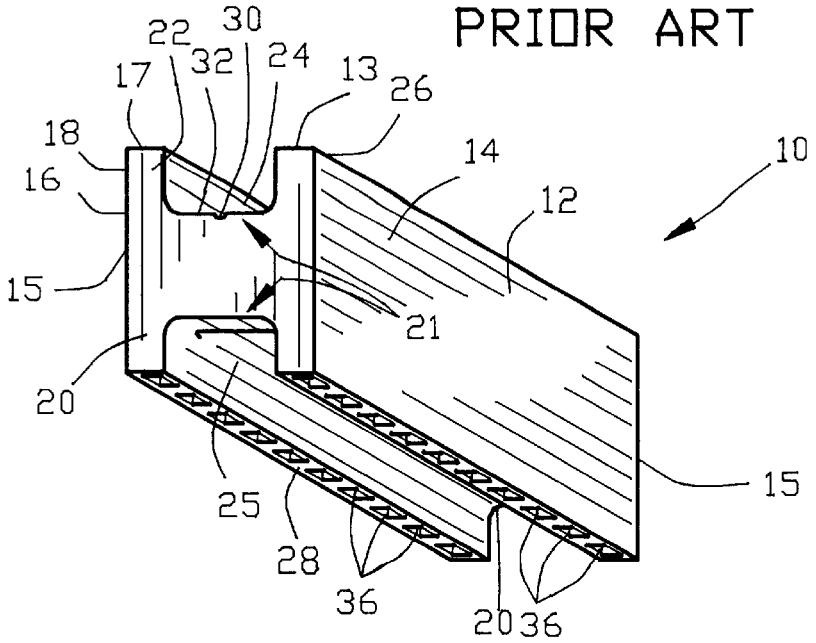
FIG. 2 is an isometric view of the interlocking block as used in the prior art illustrating a bottom surface, the face surface and the first end surface.

FIG. 1 is an upper isometric view whereas FIG. 2 is a lower isometric view of an interlocking block 10 as used in the prior art. The interlocking block 10 of the prior art is typically manufactured of a foam material such as a closed cell foam. The interlocking block 10 comprises a first rectangular section 12 having a thickness 13, a height 15 and a face surface 14. A second rectangular section 16 has a thickness 17, a height 15 and a face surface 18. The first rectangular section 12 and the second rectangular section 16 are located as parallel planes. Plural end sections 20 have a height 21 substantially less than the height 15 and 17 of first and second rectangular sections 12 and 16. The plural end sections 20 are disposed transverse to and communicate with the first rectangular section 12 and the second rectangular section 16. The plural end sections 20 have face 22 are positioned to provide a substantially equal upper aperture 24 and a lower aperture 25 in the end section 20 located proximate to the top face 26 and the bottom face 28 of the interlocking block 10. A recess 30 is disposed in each of the top surfaces 32 of the plurality of end sections 20 and central sections 38. The recess 30 are disposed substantially equidistant between the first rectangular section 12 and second rectangular section 16. A plurality of protrusions 34 are disposed proximate to the top face 26 of first and second rectangular section 12 and 16. A plurality of cavities 36 are disposed proximate to the bottom face 28.

Figure 3:
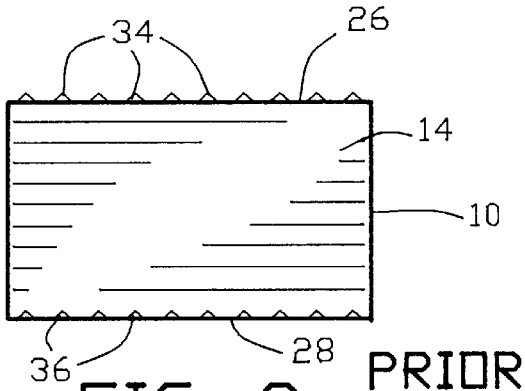
FIG. 3 PRIOR ART
FIG. 3 is a view of the face surface of the interlocking block as used in the prior art.
Figure 4:
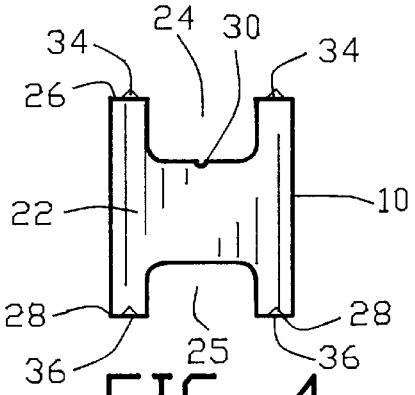
FIG. 4 PRIOR ART
FIG. 4 is an end view of the first end of the interlocking block as used in the prior art.
Figure 5:
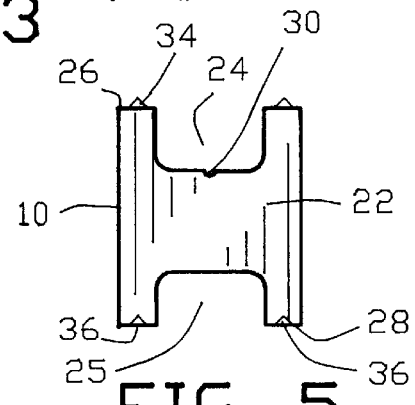
FIG. 5 PRIOR ART
FIG. 5 is an end view of a second face of the interlocking block as used in the prior art.
Figure 6:
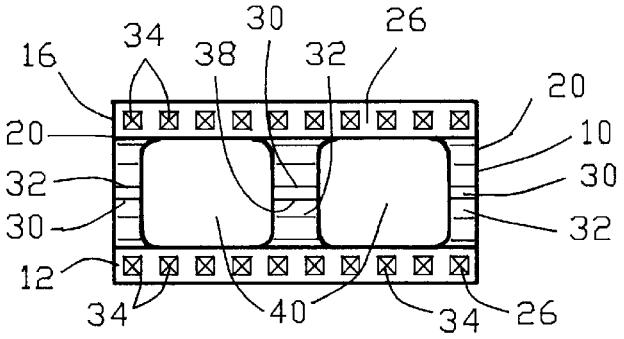
FIG. 6 PRIOR ART
FIG. 6 is a top view of the interlocking block as used in the prior art.
Figure 7:
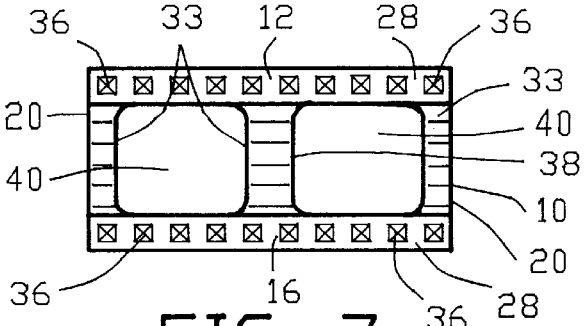
FIG. 7 is a bottom view of the interlocking block as used in the prior art.

FIG. 3 is an elevation view of the interlocking block 10 with FIGS. 4 and 5 being left and right side views thereof. FIGS. 6 and 7 are top and bottom views of FIG. 3. A plurality of vertical apertures 40 communicates with the top surface 32 of the end sections 20 and the central section 38 and extends to and communicates with the bottom surface 33 of the end sections 20 and the central section 38.

Figure 8:
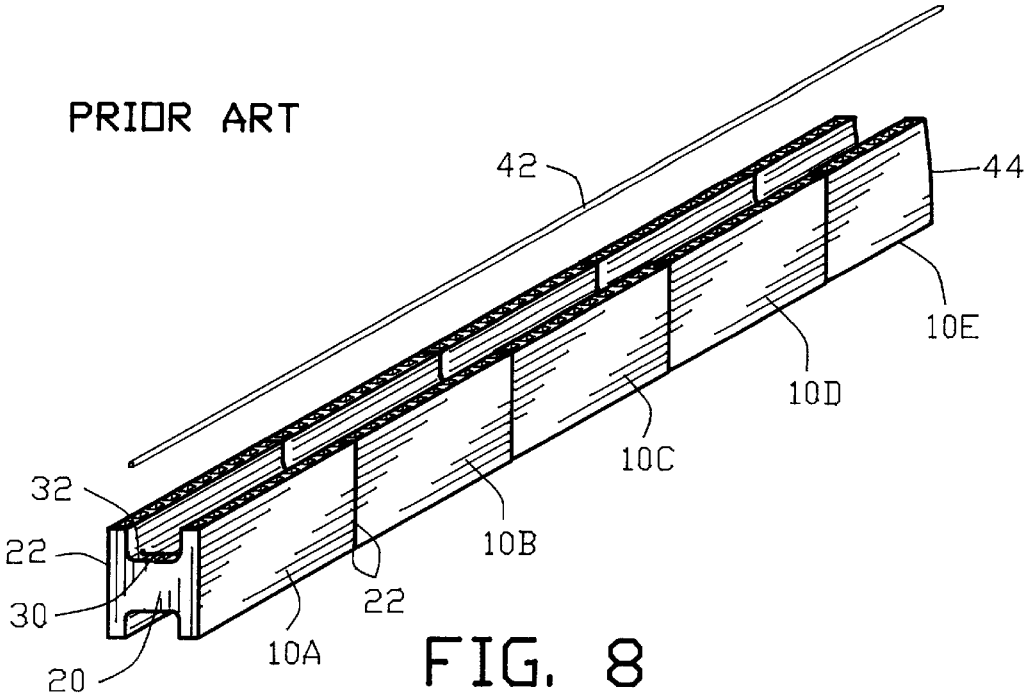
FIG. 8 is an isometric view of a first layer of interlocking blocks as used in the prior art illustrating the top surfaces, the face surfaces, the end surface and reinforcing means.

FIG. 8 is an isometric view of a first layer 44 of the blocks 10 wherein the end face 22 of a first block 10A is positioned proximate the end face 22 of a second block 10B. The first layer 44 of the blocks comprises blocks 10A–10E. Reinforcing means 42 shown as a steel reinforcing bar is illustrated prior to positioning in the plurality of recesses 30 in the top surfaces 32 of the end sections 20 and the central sections 38.

Figure 9:
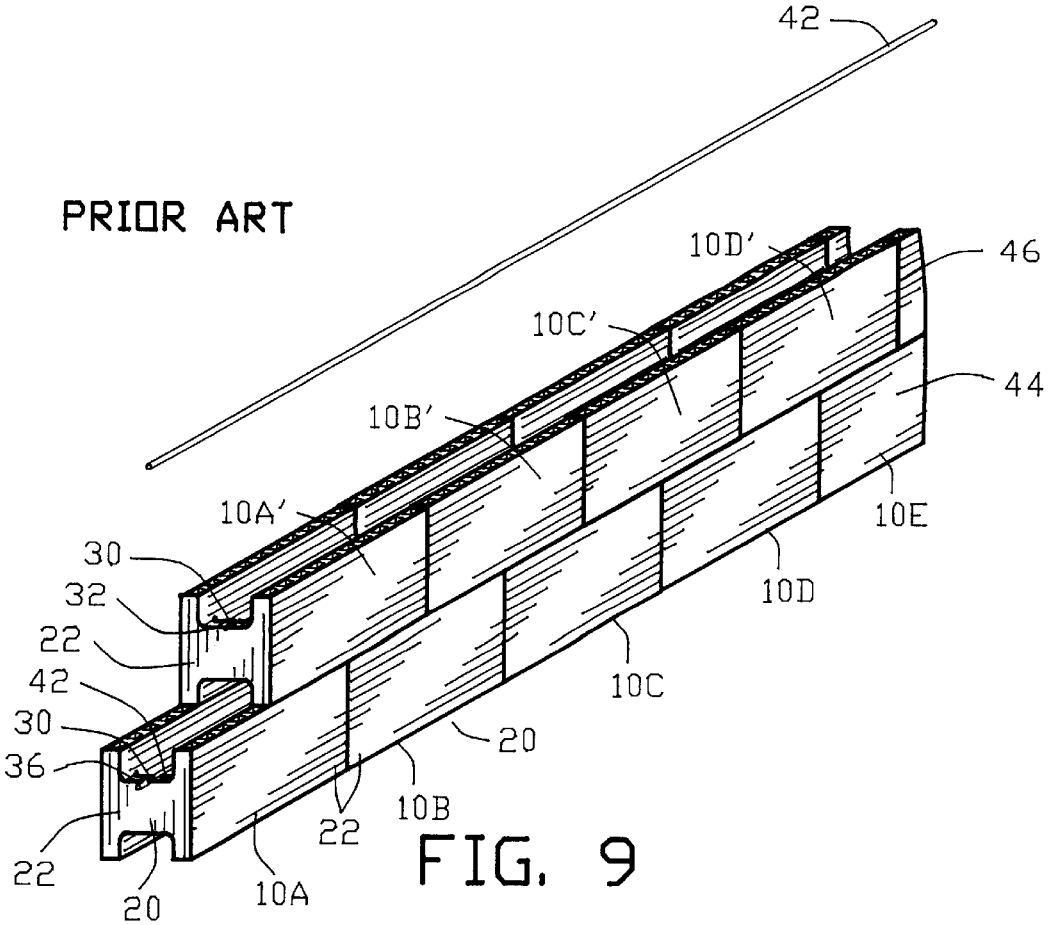
FIG. 9 is an isometric view of a second layer of interlocking blocks assembled on the first layer of the interlocking blocks as used in the prior art illustrating the top surfaces, the face surfaces, the end surfaces and reinforcing means.

FIG. 9 is an isometric view of a second layer 46 of the blocks 10' disposed upon the first layer 44 of blocks. The first layer 44 of blocks 10 comprises blocks 10A–10E whereas the second layer 46 of blocks comprises blocks 10A'–10D'. The reinforcing means 42 is positioned in plurality of recesses 30 in the top surfaces 32 of the end sections 20 and the central sections 38 of the first layer 44. The second layer 46 of blocks 10' comprises a first block 10A' positioned with bottom face 28 of first block 10A' of second layer 46 proximate top face 26 of block 10A of first layer 44 of blocks 10.

The plurality of protrusions 34 disposed proximate to the top face 26 of the blocks 10A–10E of the first layer 44 are received within the plurality of cavities 36 disposed proximate to the bottom face 28 of the blocks 10A'–10D' of the second layer 46. The reception of the protrusions 34 of the blocks 10A–10E of the first layer 44 by the plurality of cavities 36 in the blocks 10A'–10D' of the second layer 46 interlocks the blocks of the blocks 10A–10E of the first layer 44 to the blocks 10A'–10D' of the second layer 46.

The second layer 46 is staggered relative to first layer 44 wherein a plane extending from interface of the first and second end face 22 of the blocks 10A and 10B bisects a first block 10A' in second layer 46 of the blocks 10. The blocks 10' of second layer 46 are positioned relative to the blocks 10 of the first layer 44 to enable the protrusions 34 in the blocks 10 to be received within the cavities 36 of the blocks 10' for interlocking the blocks 10 and 10'. The reinforcing means 42 is illustrated prior to positioning in the plurality of recesses 30 in the top surfaces 32 of the end sections 20 and the central sections 38. The plurality of vertical apertures 40 in the blocks 10 and 10' communicating with the upper apertures 24 and the lower apertures 25 provides a contiguous void matrix 56 for accepting slurry of curable material 52 such as concrete or the like.

Figure 10:
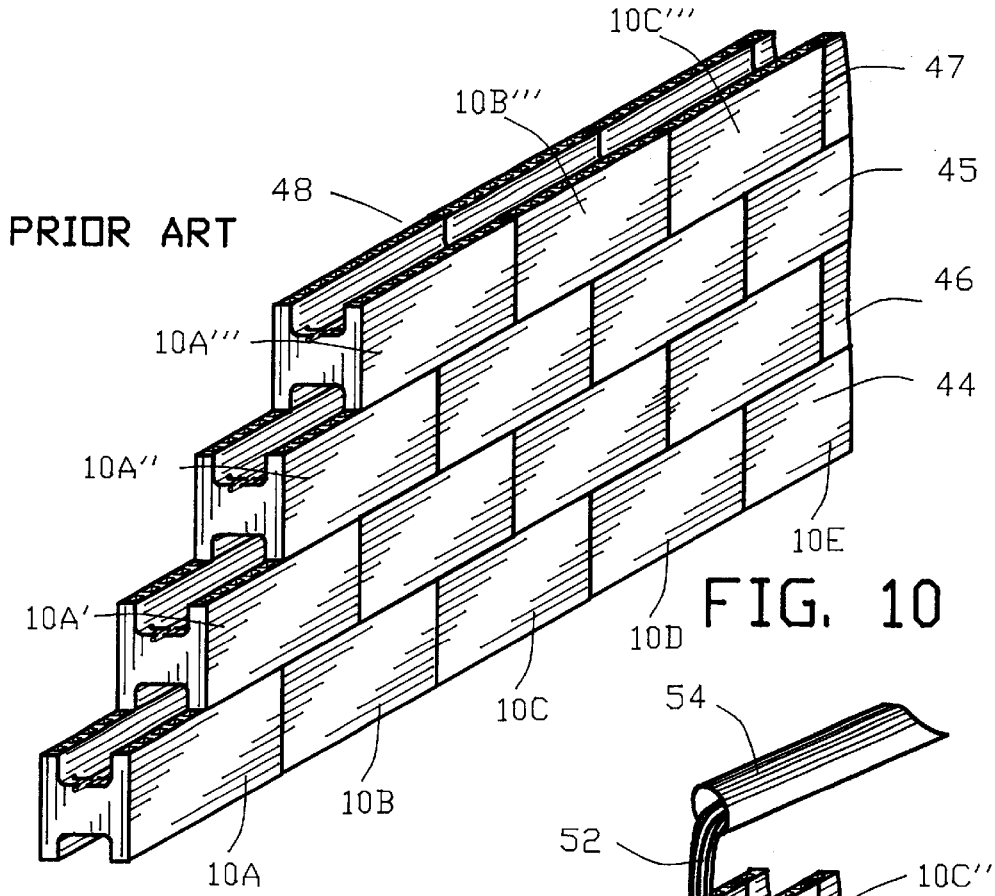
FIG. 10 is an isometric view of a wall comprising four layers of interlocking blocks as used in the prior art illustrating the top surfaces, the face surfaces and the end surfaces.
Figure 12:
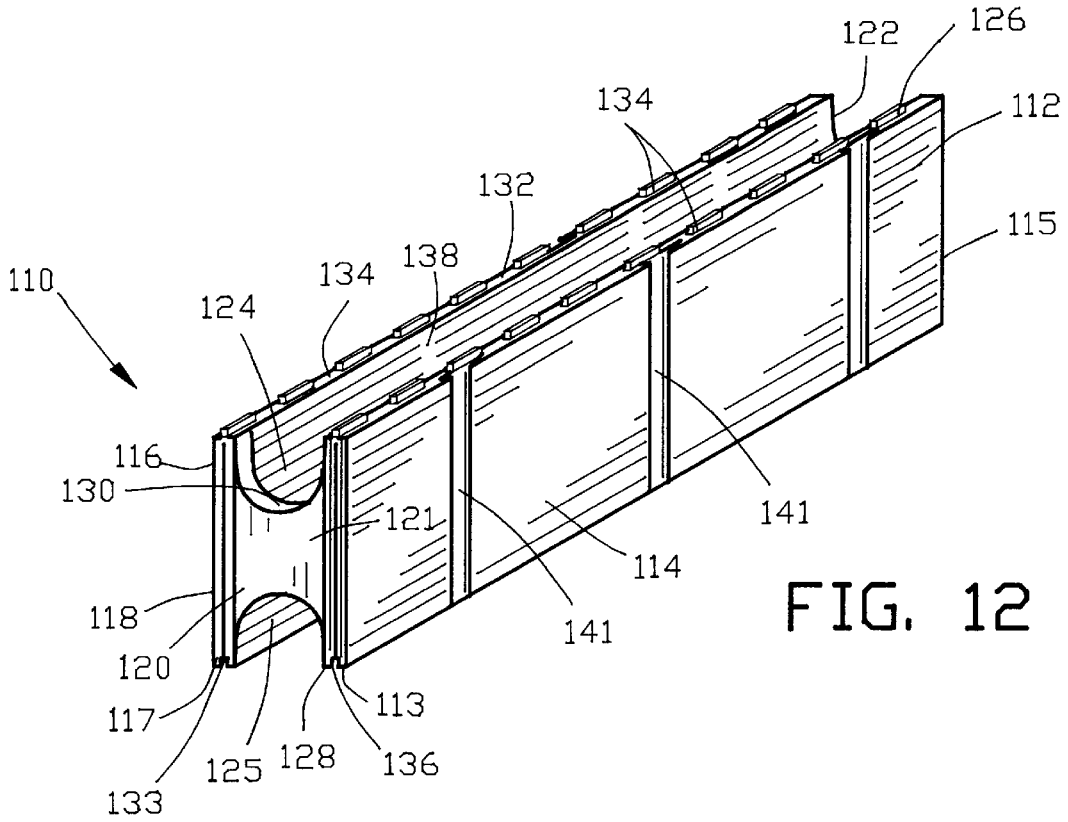
FIG. 12 is an upper isometric view of a first interlocking block as used in the present invention illustrating a top surface, an outer face surface, an end surface with a plurality of outer grooves defined in an outer face surface of the interlocking block.
Figure 13:
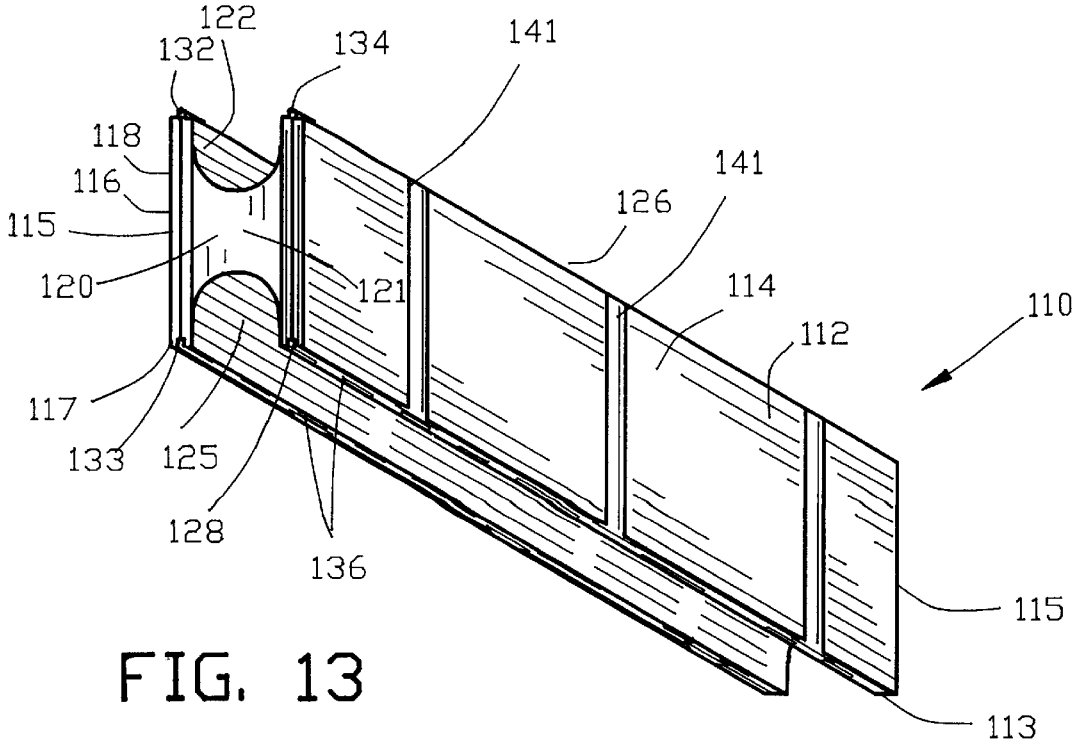
FIG. 13 is a lower isometric view of the first interlocking block as used in the present invention illustrating a bottom surface, the outer face surface and the end surface with the plurality of outer grooves defined in the outer face surface of the interlocking block.

FIG. 10 is an isometric view of a plurality of layers 44–47 of blocks 10, 10', 10" and 10'" comprising the wall 48 constructed as previously described and illustrated in FIGS. 12 and 13. The blocks 10', 10" and 10'" are positioned relative to the blocks 10 of the lower layer to enable the protrusions 34 in the blocks 10 to be received within the cavities 36 of the blocks 10 for interlocking the blocks within the plurality of layers 44–47.

Figure 11:
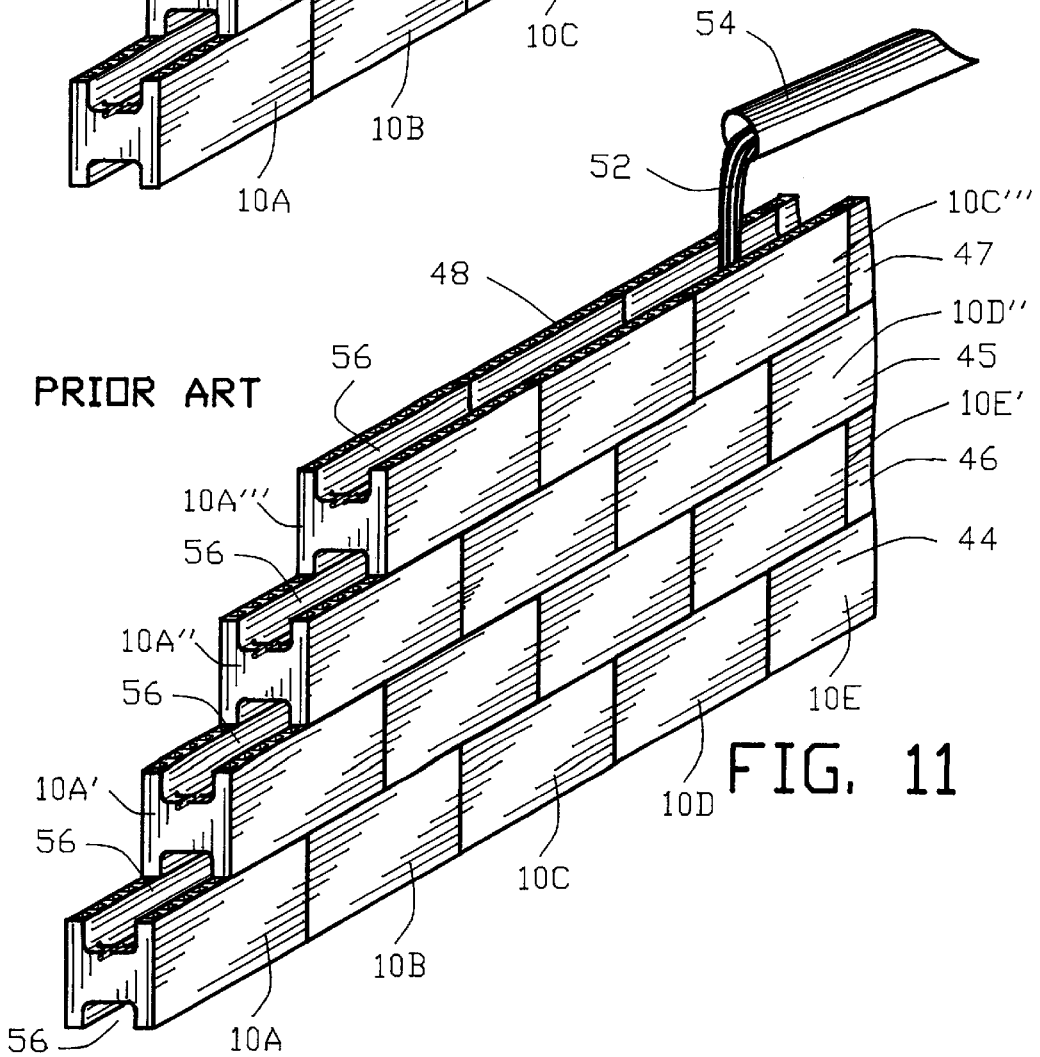
FIG. 11 is an isometric view of the wall comprising four layers of interlocking blocks as used in the prior art illustrating the top surfaces, the face surfaces, the end surfaces and the delivery of a slurry of curable material.

FIG. 11 is an isometric view of the plurality of layers 44–47 of the interlocking blocks 10, 10', 10" and 10'" comprising a wall 48 constructed as previously described and illustrated in FIGS. 8, 9 and 10. FIG. 11 further illustrates the delivery of slurry of curable material 52 such as a cementitious material, concrete or the like from a delivery means 54. The delivery means 54 delivers the slurry of the curable material 52 to the plurality of vertical apertures 40 in blocks 10'" of layer 47 which communicates with upper apertures 24 and lower apertures 25 and the plurality of vertical apertures 40 of the plurality of layers 44–47. The curable material 52 provides a contiguous matrix 56 of curable material 52 such as concrete or the like.

The use of interlocking blocks 10 for the construction of the wall 48 provides a wall structure that is stronger than a wall constructed from conventional concrete blocks. Furthermore, the use of interlocking blocks 10 for the construction of the wall 48 is easier and faster than the construction of a wall constructed from conventional concrete blocks. In addition, use of interlocking blocks 10 for the construction of the wall 48 provides a vapor barrier as well as insulation for the wall 48.

Although the use of interlocking blocks 10 for the construction of the wall 48 has provided a stronger and less expensive wall with a vapor barrier and insulation, the use of interlocking blocks of the prior art has certain disadvantages. One significant disadvantage of the interlocking foam blocks 10 of the prior art shown in FIGS. 1–11 is the difficulty of affixing an outer and/or an inner facing material to the blocks 10. In addition, difficultly is encountered in maintaining the alignment and position of the blocks 10 within the plurality of layers 44–47 during the delivery of slurry of curable material 52.

FIGS. 12 and 13 are upper and lower isometric views of a first interlocking block 110 as used in the present invention. The interlocking block 110 comprises a first rectangular section 112 having a thickness 113, a height 115 and a face surface 114. A second rectangular section 116 has a thickness 117, a height 115 and a face surface 118. The first rectangular section 112 and second rectangular section 116 are substantially parallel to one another. Plural end sections 120 having a height 121 substantially less than the height 115 interconnect the first and second rectangular sections 112 and 116. A plurality of central sections 138 angularly communicate with the first rectangular section 112 and the second rectangular section 116. Each of the plural sections 120 has a face 122 positioned to provide a substantially equal upper aperture 124 and a lower aperture 125 in each of the sections 120. In addition, the plurality of central sections 138 define the substantially equal upper aperture 124 and a lower aperture 125.

The upper aperture 124 and lower apertures 125 are located proximate to the top face 126 and the bottom face 128 of first interlocking block 110. A recess 130 is disposed in the top surface 132 of each of the plurality of sections 120 substantially equidistant between the first rectangular section 112 and the second rectangular section 116.

A plurality of protrusions 134 are disposed proximate the top face 126 of first and second rectangular sections 112 and 116. A plurality of cavities 136 are disposed proximate the bottom face 128 of block 110. A plurality of outer grooves 141 are disposed in alignment with the face surface 114 of the interlocking first blocks 110.

Figure 14:
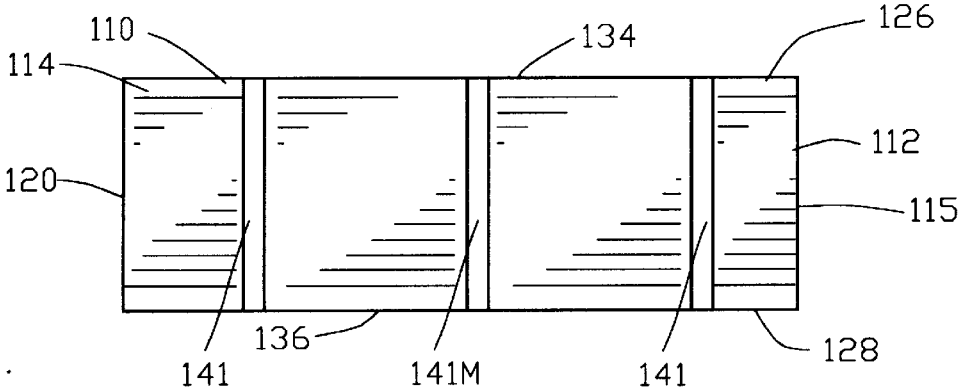
FIG. 14 is a front view of a face of the first interlocking block as used in the present invention illustrating the plurality of outer grooves defined in the outer face surface of the no interlocking block.
Figure 15:
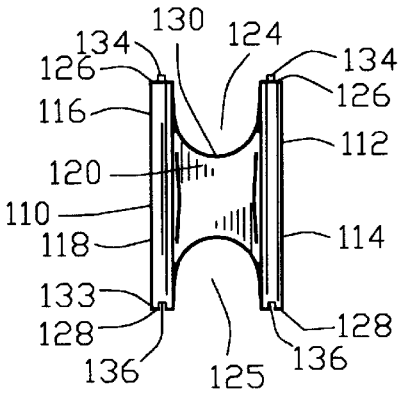
FIG. 15 is an end view of the first end of the first interlocking block as used in the present invention.
Figure 16:
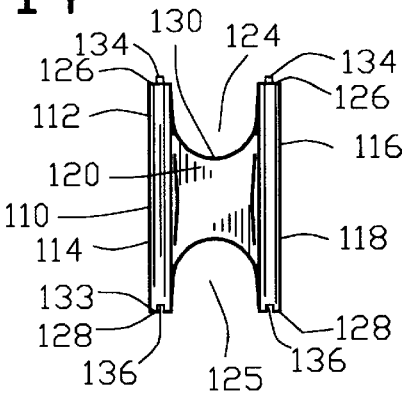
FIG. 16 is an end view of a second end of the first interlocking block as used in the present invention.
Figure 17:
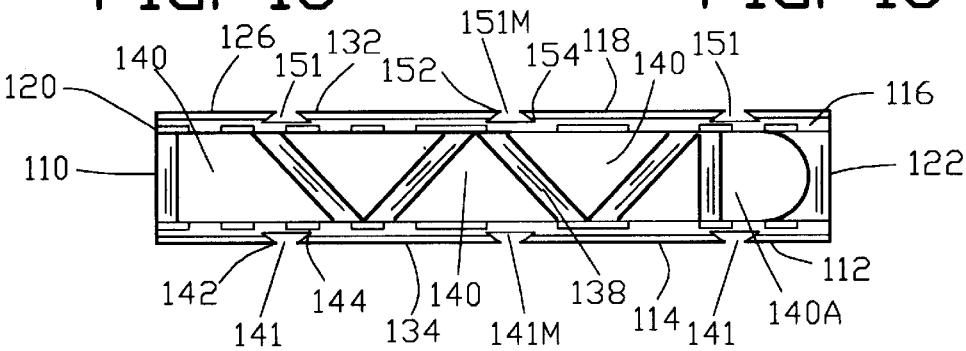
FIG. 17 is a top view of the first interlocking block as used in the present invention.
Figure 18:
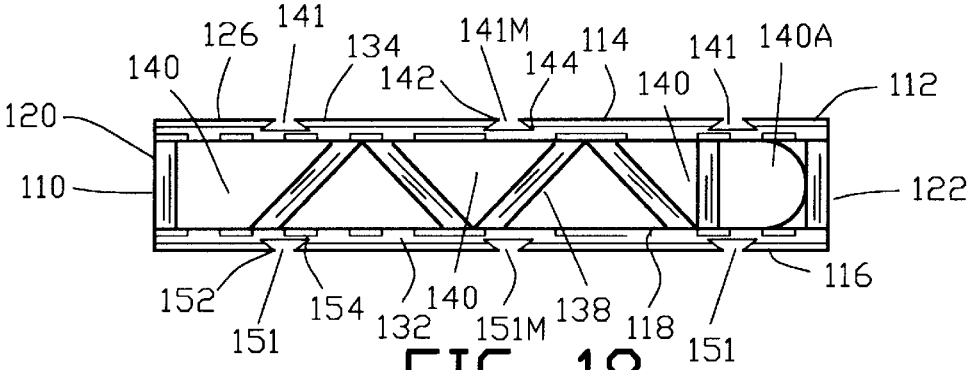
FIG. 18 is a bottom view of the first interlocking block as used in the present invention.

FIG. 14 is an elevation view of the first interlocking block 110 with FIGS. 15 and 16 being left and right side views thereof. FIGS. 17 and 18 are top and bottom views of FIG. 14. A plurality of vertical apertures 140 communicates with top surface 132 of end sections 120 and central section 138 and extend to and communicates with bottom surface 133 of end sections 120 and central section 138. A vertical aperture 140A is disposed adjacent the end face 122 and is partially cylindrical. The partially cylindrical vertical aperture 140A facilitates the forming of a corner of a wall (not shown) by enabling an alignment of the a plurality of layers of blocks comprising the wall (not shown).

A plurality of outer grooves 141 are disposed in alignment with the face surface 114 of the first rectangular section 112. The plurality of outer grooves 141 have a trapezoidal cross-section with a minor base 142 disposed in alignment with the face surface 114 of interlocking block 110 and the major base 144 disposed internal to first rectangular section 112.

A plurality of inner grooves 151 are disposed in alignment with the face surface 118 of the second rectangular section 116. The plurality of inner grooves 151 have a trapezoidal cross-section with a minor base 152 disposed in alignment with the face surface 118 of interlocking block 110 and the major base 154 disposed internal to second rectangular section 116.

The first interlocking block 110 of FIGS. 12–18 have three outer grooves 141 and three inner grooves 151. The outer and inner grooves 141M and 151M are located at a midpoint of the first block 110 and with the other of the outer and inner groves 141 and 151 being spaced sixteen inches from the outer and inner grooves 141M and 151M.

Figure 19:
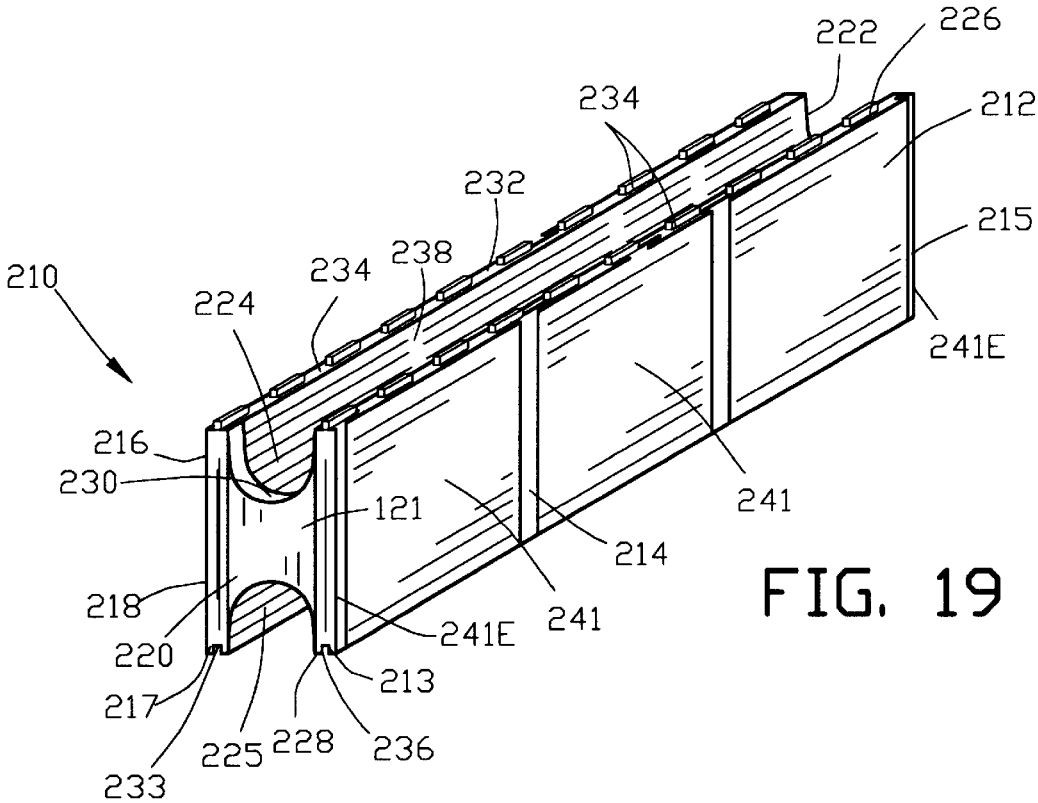
FIG. 19 is an upper isometric view of a second interlocking block as used in the present invention illustrating a top surface, an outer face surface, an end surface with a plurality of outer grooves defined in an outer face surface of the interlocking block.
Figure 20:
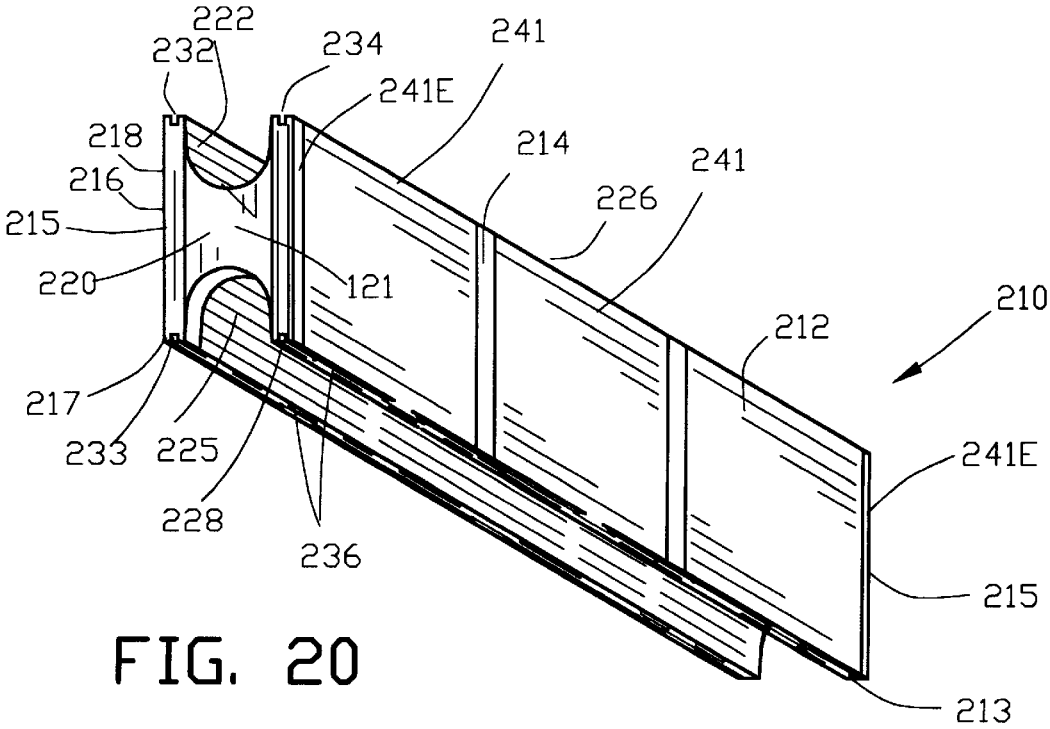
FIG. 20 is a lower isometric view of the second interlocking block as used in the present invention illustrating a bottom surface, the outer face surface and the end surface with the plurality of outer grooves defined in the outer face surface of the interlocking block.

FIGS. 19 and 20 are upper and lower isometric views of a second interlocking block 210 as used in the present invention. The interlocking block 210 comprises a first rectangular section 212 having a thickness 213, a height 215 and a face surface 214. A second rectangular section 216 has a thickness 217, a height 215 and a face surface 218. The first rectangular section 212 and second rectangular section 216 are substantially parallel to one another. Plural end sections 220 having a height 221 substantially less than the height 215 interconnect the first and second rectangular sections 212 and 216. A plurality of central sections 238 angularly commnunicate with the first rectangular section 212 and the second rectangular section 216. Each of the plural sections 220 has a face 222 positioned to provide a substantially equal upper aperture 224 and a lower aperture 225 in each of the sections 220. In addition, the plurality of central sections 238 define the substantially equal upper aperture 224 and a lower aperture 225.

The upper aperture 224 and lower apertures 225 are located proximate to the top face 226 and the bottom face 228 of second interlocking block 210. A recess 230 is disposed in the top surface 232 of each of the plurality of sections 220 substantially equidistant between the first rectangular section 212 and the second rectangular section 216.

A plurality of protrusions 234 are disposed proximate the top face 226 of first and second rectangular sections 212 and 216. A plurality of cavities 236 are disposed proximate the bottom face 228 of block 210. A plurality of outer grooves 241 are disposed in alignment with the face surface 214 of the interlocking second blocks 210.

Figure 21:
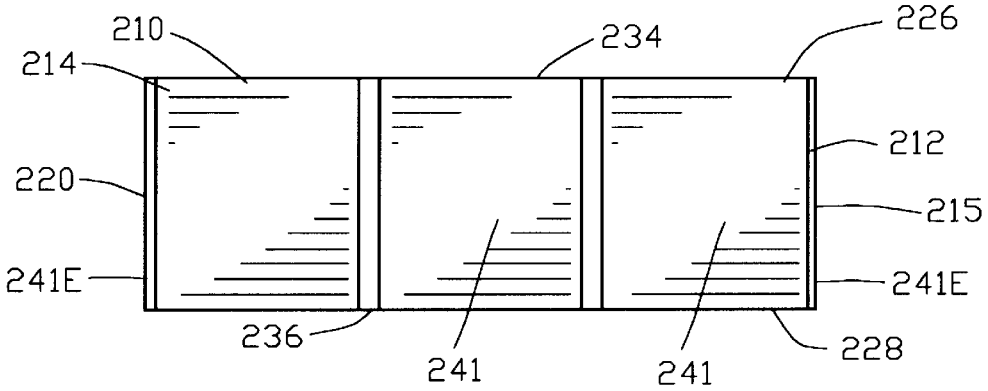
FIG. 21 is a front view of a face of the second interlocking block as used in the present invention illustrating the plurality of outer grooves defined in the outer face surface of the interlocking block.
Figure 22:
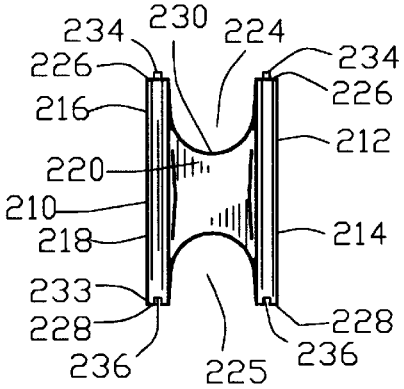
FIG. 22 is an end view of the first end of the second interlocking block as used in the present invention.
Figure 23:
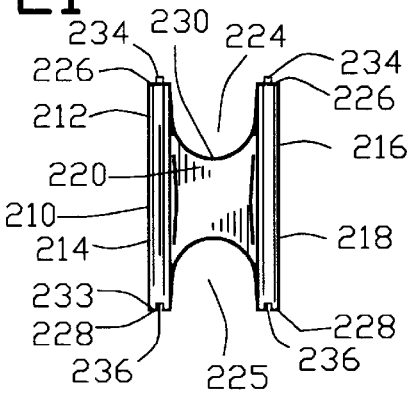
FIG. 23 is an end view of a second end of the second interlocking block as used in the present invention.
Figure 24:
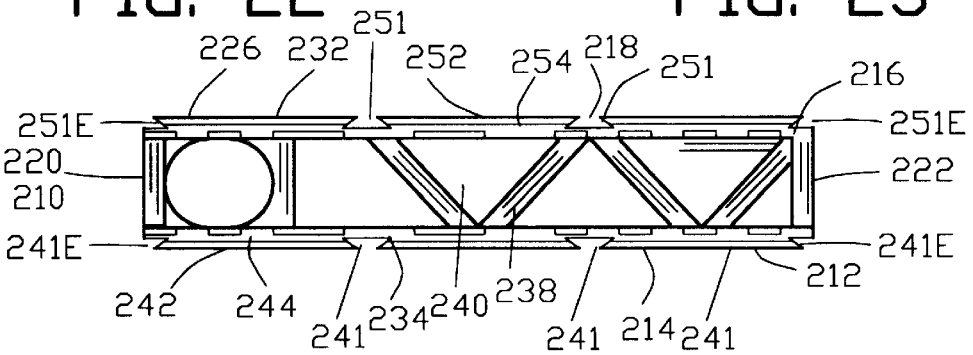
FIG. 24 is a top view of the second interlocking block as used in the present invention.
Figure 25:
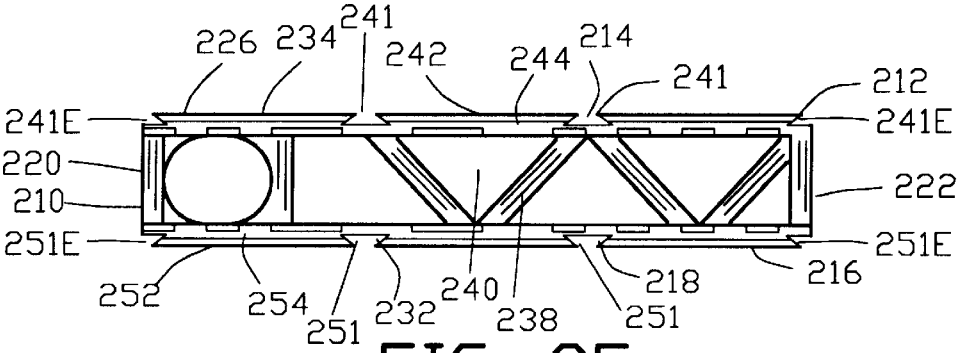
FIG. 25 is a bottom view of the second interlocking block as used in the present invention.

FIG. 21 is an elevation view of the second interlocking block 210 with FIGS. 22 and 23 being left and right side views thereof. FIGS. 24 and 25 are top and bottom views of FIG. 21. A plurality of vertical apertures 240 communicates with top surface 232 of end sections 220 and central section 238 and extend to and communicates with bottom surface 233 of end sections 220 and central section 238. A vertical aperture 240A is disposed adjacent the end face 222 and is partially cylindrical. The partially cylindrical vertical aperture 240A facilitates the forming of a comer of a wall (not shown) by enabling an alignment of the a plurality of layers of blocks comprising the wall (not shown).

A plurality of outer grooves 241 are disposed in alignment with the face surface 214 of the first rectangular section 212. The plurality of outer grooves 241 have a trapezoidal cross-section with a minor base 242 disposed in alignment with the face surface 214 of interlocking block 210 and the major base 244 disposed internal to first rectangular section 212.

A plurality of inner grooves 251 are disposed in alignment with the face surface 218 of the second rectangular section 216. The plurality of inner grooves 251 have a trapezoidal cross-section with a minor base 252 disposed in alignment with the face surface 218 of interlocking block 210 and the major base 254 disposed internal to second rectangular section 216.

The second interlocking block 210 of FIGS. 19–25 have two full outer grooves 241 and two half outer grooves 241E as well as two full inner grooves 251 and two half inner grooves 251E. The outer and inner half grooves 241E and 251E are located at ends of the second block 210 and with the other of the outer and inner groves 241 and 251 being spaced sixteen inches from the outer and inner grooves 241E and 251E.

The location of the outer and inner grooves 141 and 151 of the first interlocking block 110 cooperates with the location of the outer and inner grooves 241 and 251 of the second interlocking block 210. More specifically, the outer and inner grooves 141 and 151 of the first interlocking block 110 will align with the outer and inner grooves 241 and 251 of the second interlocking block 210 when a layer of the first blocks 110 is staggered relative to a layer of second blocks 210. A layer of the first blocks 110 is staggered relative to a layer of second blocks 210 when a plane extending from interface of the first and second end faces of the first blocks 110 bisects the second block 210 in another layer of the blocks 210. The outer and inner grooves 141 and 151 of the first interlocking block 110 and the outer and inner grooves 241 and 251 of the second interlocking block 210 provide a plurality of continuous outer and inner vertically oriented grooves.

Figure 26:
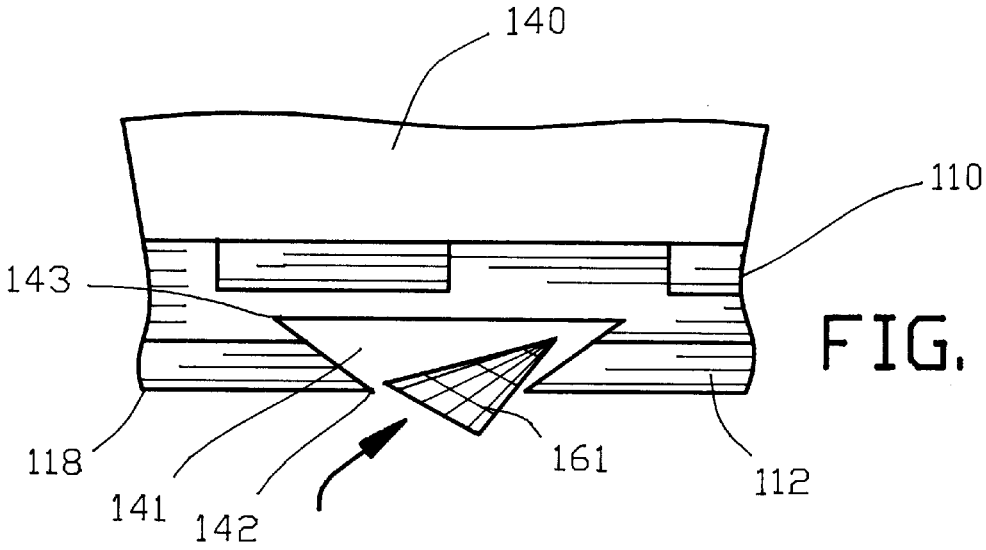
FIG. 26 is a partial enlarged top view of the interlocking block as used in the present invention illustrating the insertion of a first mounting strip having a triangular cross section into an outer groove defined in the outer face surface of the interlocking block.

FIG. 26 is an enlarged top view of a portion of the interlocking block 110 of FIG. 17 of the present invention. The outer groove 141 has a trapezoidal cross-section with a minor base 142 of the trapezoidal cross-section being disposed in alignment with the face surface 114 of interlocking block 110. The major base 144 is disposed internal to first rectangular section 112. A first mounting strip 161 having a triangular cross section is shown being inserted into the outer groove 141.

Figure 27:
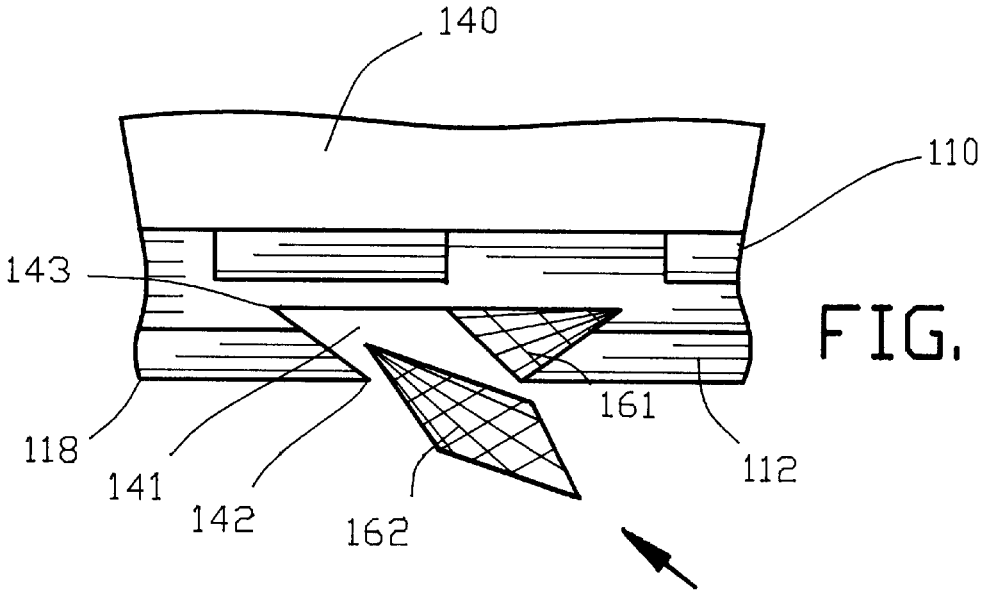
FIG. 27 is a top detail view of the interlocking block as used in the present invention and illustrating the insertion of a second mounting strip having a rhomboidal cross-section into the outer groove defined in the outer face surface of the interlocking block adjacent the first mounting strip.

FIG. 27 is an enlarged top view similar to FIG. 26 illustrating the second mounting strip 162 having a rhomboidal cross-section being inserted into the outer groove 141.

Figure 28:
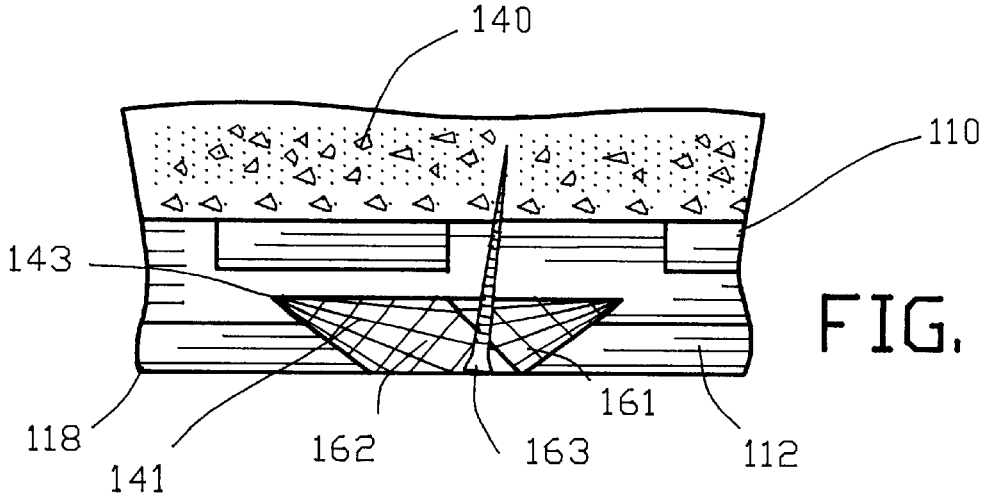
FIG. 28 is a top detail view of the interlocking block as used in the present invention illustrating fastening means for fixing the first mounting strip having the triangular cross section to the second mounting strip having the rhomboidal cross-section for securing the first and second mounting strip to the outer groove defined in the outer face surface of the interlocking block.

FIG. 28 is an enlarged top view similar to FIG. 27 illustrating the complete insertion of the second mounting strip 162 into the outer groove 141. The second mounting strip 148 is inserted within the outer groove 151 adjacent to the first mounting strip 161 for substantially filling the outer wall groove 141. Preferably, the mounting strips 161 and 162 comprises wood furring strips.

A fastening means 163 fixes the rhomboidal cross-section second mounting strip 162 to the triangular cross-section first mounting strip 161 to interlock the first and second mounting strips 161 and 162 within the outer groove 151 to provide a mounting for attaching a facing material to an outer wall. In this embodiment, the fastening means 163 comprises a mechanical fastener which may comprise a nail, screw, or the like. The fastening means 163 extends into the vertical aperture 140 of the interlocking blocks for being retained by the curable material 52 filled within the vertical aperture 140 of the interlocking foam block 110.

The fastening means 163 secures the first and second mounting strips 161 and 162 to each other and substantially enables first and second mounting strips 161 and 162 to act as a single unit thereby filling the trapezoidal cross-section of outer groove 141. The first and second mounting strips 161 and 162 prevents extraction of first and second mounting strips 161 and 162 from outer groove 141.

Preferably, the fastening means 163 fixes the first and second mounting strips 161 and 162 within the outer groove 151 prior to the introduction of the curable material 52 into the vertical aperture 140 of the interlocking foam block 110. The first and second mounting strips 161 and 162 fixed within the outer groove 151 assists in maintaining the alignment and position of the blocks 110 during the delivery of slurry of curable material 52. Upon the curing of the curable material 52, the curable material 52 locks the fastening means 173 within the vertical aperture 140.

Figure 29:
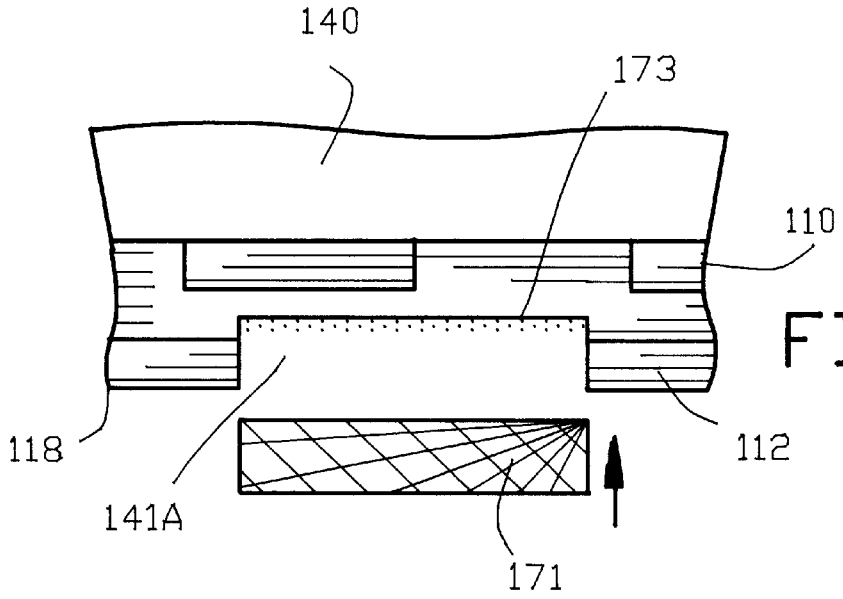
FIG. 29 is a top detail view of the interlocking block as used in the present invention and illustrating an alternative mounting strip having a rectangular cross-section and an outer groove defined in the outer face surface of the interlocking block.

FIG. 29 is an enlarged top view of a portion of the interlocking block 110 similar to FIG. 26 illustrating an alternative mounting strip 171 having a rectangular cross-section and an outer groove 141A defined in the outer face surface 118 of the interlocking block 110. An adhesive 173 is disposed within the outer groove 141A for securing the mounting strip 171 within the outer groove 141A of the interlocking block 110.

Figure 30:
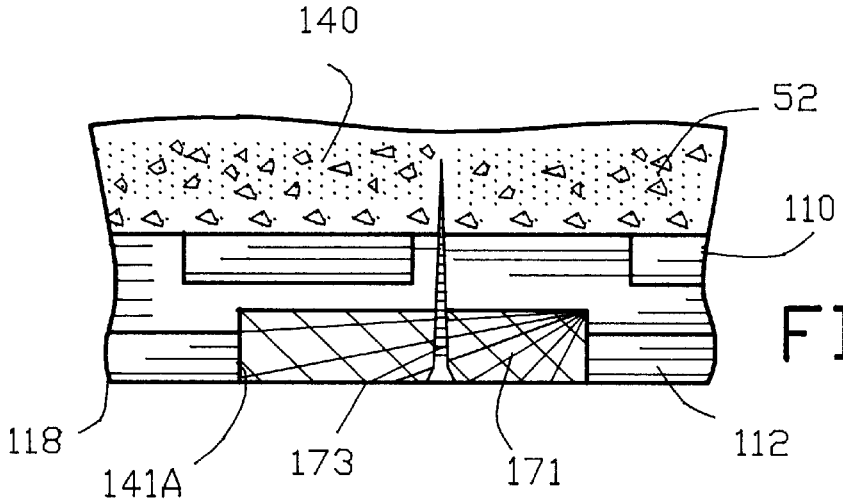
FIG. 30 is a top detail view of the interlocking block as used in the present invention illustrating fastening means for fixing the alternative mounting strip having a rectangular cross-section for securing the alternative mounting strip to the outer groove defined in the outer face surface of the interlocking block.

FIG. 30 is an enlarged top view similar to FIG. 29 illustrating the complete insertion of the alternative mounting strip 171 into the outer groove 141A for substantially filling the outer wall groove 141A. Preferably, the alternative mounting strip 171 comprises a wood furring strip.

A fastening means 173 extends into the vertical aperture 140 of the interlocking blocks for being retained by the curable material 52 filled within the vertical aperture 140 of the interlocking foam block 110. The curable material 52 locks the fastening means 173 within the vertical aperture 140.

Figure 31:
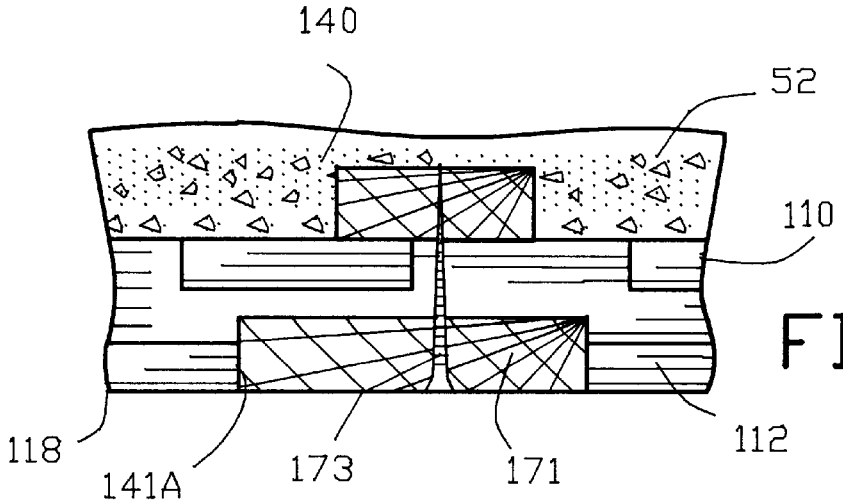
FIG. 31 is a top detail view of the interlocking block as used in the present invention illustrating an alternative fastening means for fixing the alternative mounting strip having a rectangular cross-section for securing the alternative mounting strip to the outer groove defined in the outer face surface of the interlocking block.

FIG. 31 is a top detail view similar to FIG. 30 illustrating an alternative fastening means 173 for fixing the alternative mounting strip 171 with the outer groove 141A defined in the outer face surface 118 of the interlocking block 110.

A fastening means 173 extends into a backing strip 175 located within the vertical aperture 140 of the interlocking blocks 110. Preferably, the backing strip 175 comprises a wood furring strip with the fastening means 173 being secured therein.

Figure 32:
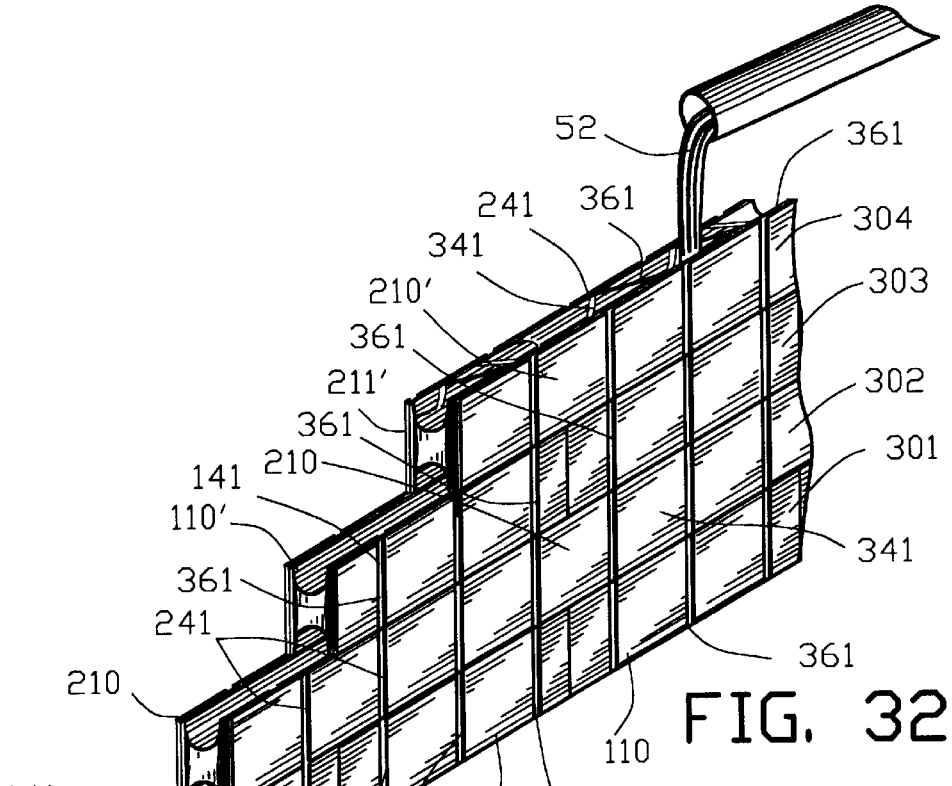
FIG. 32 is an isometric view of a wall comprising four layers of interlocking blocks as used in the present invention illustrating the plurality of outer grooves defined in the outer face surface of the interlocking blocks and the delivery of a slurry of curable material.

FIG. 32 is an isometric view of a wall 300 comprising a plurality of layers 301–304 of blocks 110, 210, 110' and 210' constructed in a manner as previously described and illustrated in FIGS. 12 and 13. The wall 300 comprises the first layer 301 of the first blocks 110 with the second layer 302 of the second blocks 2110 disposed upon the first layer 301 of the first blocks 110. The third layer 303 of the first blocks 110' is disposed on the second layer 302 of the second blocks 210 with the fourth layer 304 of the second blocks 210' being disposed upon the third layer 303 of the first blocks 110'.

The plurality of protrusions disposed proximate to the top face of the blocks 110 of the first layer 301 are received within the plurality of cavities disposed proximate to the bottom face of the second blocks 210 of the second layer 302. In a similar manner, the blocks 110' and 210' of the third and fourth layers 303 and 304 are interlocked by the plurality of protrusions and the plurality of cavities. Preferably, reinforcing means (not shown) as previously described is positioned between the layer 301–304 of the blocks 110, 110', 210 and 201'.

The second layer 302 is staggered relative to first layer 301 wherein a plane extending from interface of tow adjacent first blocks 110 of the first layer 301 bisects a second block 210 in the second layer 302. In a similar manner, the blocks 110' and 210' of the third and fourth layers 303 and 304 are similarly staggered. The plurality of vertical apertures 140 in the first blocks 110 and 110' communicating with the plurality of vertical apertures 240 in the second blocks 210 and 210' to provide contiguous vertical voids for accepting slurry of curable material 52 such as concrete or the like.

The staggering of adjacent layers 301–304 results in the alignment of the outer grooves 141 of the first blocks 110 and 110' with the outer grooves 241 of the second blocks 210 and 210' to provide a plurality of continuous outer vertically oriented grooves 341. In addition, the inner grooves 151 of the first blocks 110 and 110' are aligned with the inner grooves 251 of the second blocks 210 and 210' to provide a plurality of continuous inner vertically oriented grooves (not shown).

A plurality of outer mounting strip 361 are disposed in the plurality of outer grooves 341. Each of the plurality of outer mounting strip 361 extend through the layers 301–304 of the blocks 110, 100' 210 and 210' to maintain the alignment and position of the blocks 110, 110', 210 and 210' during the delivery of slurry of curable material 52 as shown in FIG. 32. Upon the curing of the curable material 52, the curable material 52 locks the fastening means as shown in FIGS. 28, 30 and 31 within the vertical apertures 140 and 240.

Figure 33:
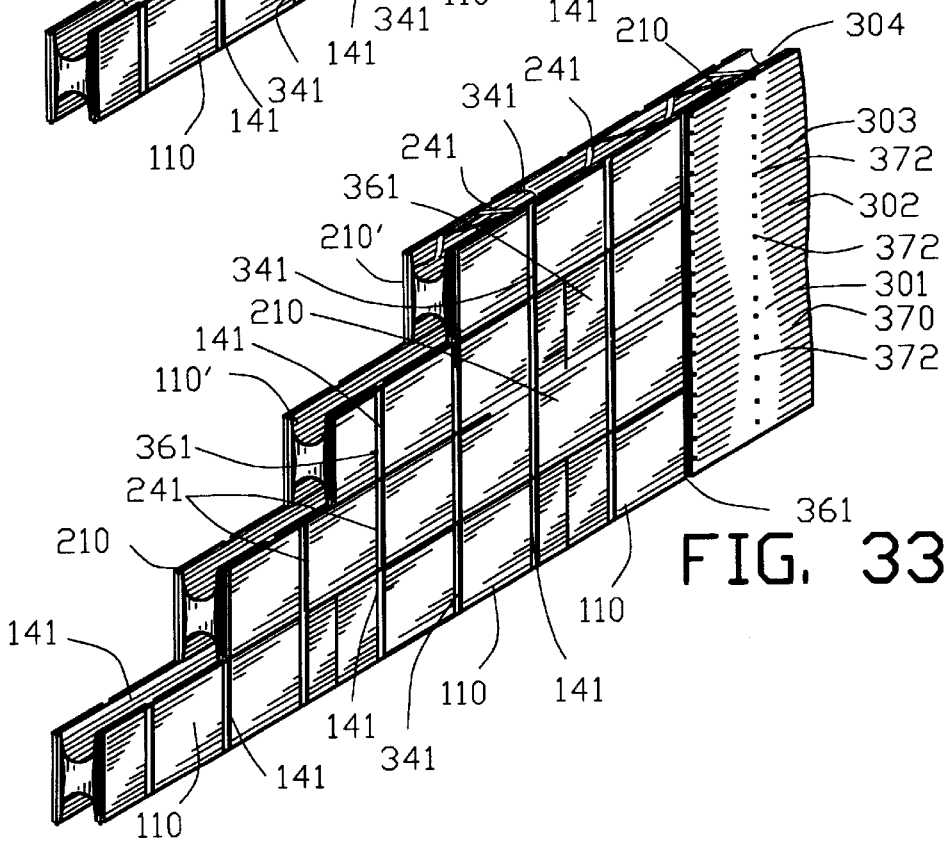
FIG. 33 is an isometric view of a wall comprising four layers of interlocking blocks as used in the present invention illustrating the fastening of a facing material to the first and second mounting strip to attach the facing material to the wall.

FIG. 33 is an isometric view of a plurality of layers 301–304 of blocks 110, 210, 110' and 210' with the plurality of outer mounting strip 361 disposed in the plurality of outer grooves 341. The plurality of outer mounting strip 361 disposed in the plurality of outer grooves 341 provides a mounting for attaching a facing material 370. The facing material 370 many be any type of sheet material and may be made of various materials such as a natural or synthetic material. Preferably, the facing material 370 is secured to the plurality of outer mounting strip 361 by mechanical fasteners such as nails, screws or the like. In one example of this invention, the facing material 370 is a wood facing material for providing a wood outer appearance to the wall 300. The plurality of outer mounting strip 361 disposed in the plurality of outer grooves 341 provides a simple efficient and reliable means for attaching the facing material 370 to the wall 300. Through the use if the present invention, the facing material 370 is connected to the plurality of outer mounting strip 361 by mechanical fasteners 372 with the plurality of outer mounting strip 361 being secured by mechanical fasteners 163 being retained by the curable material 52 filled within the vertical apertures 140 and 240 of the first and second blocks 110 and 210.

An alternative method of practicing the present invention includes forming the plurality of outer grooves 341 and/or the plurality of inner grooves subsequent to the stacking of the first and second blocks 110 and 210 within the wall 300. The plurality of outer grooves 341 may be formed in any of the shapes set forth in FIGS. 26–31 through the use of a hot wire cutter. Thereafter, the outer mounting strip may be installed as set forth herein. In the event that the plurality of outer grooves 341 are formed in the wall 300 subsequent to the curing of the curable material 52 within the vertical apertures 140 and 240, then the outer mounting strip may be secured by mechanical fasteners projected into the cured material 52 within the vertical apertures 140 and 240.

The use of interlocking blocks 110 and 210 of the present invention for the construction of the wall 300 provides a wall structure that is stronger than a wall constructed from conventional concrete blocks that is easier and faster than the construction of a wall constructed from conventional concrete blocks while providing a simple efficient and reliable means for attaching the facing material 370 to the wall 300.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A stabilization and mounting apparatus for stabilizing a wall during the filling and curing thereof and for attaching a facing material to the wall, the wall being constructed from multiple vertically disposed layers of a plurality of foam blocks with each of the plurality of foam blocks having a vertical aperture filled with a curable material, the improvement comprising:

a groove defined in a block surface of each of the plurality of foam blocks;

said grooves in one said vertically disposed layer of the plurality of foam blocks being aligned with said grooves in adjacent said vertically disposed layers of the plurality of foam blocks for providing vertically disposed continuous wall grooves;

a mounting strip located within each of said vertically disposed continuous wall grooves and extending through said multiple vertically disposed layers of the foam blocks;

fasteners securing said mounting strips within said continuous wall grooves for interlocking adjacent said vertically disposed layers of said plurality of foam blocks for stabilizing the wall during the filling of the vertical apertures with the curable material; and said mounting strips providing a mounting for attaching the facing material to the wall.

2. An improved stabilization and mounting apparatus as set forth in claim 1, wherein each of said plurality of foam blocks includes a first and a second end surface, a top surface and a bottom surface;

each of said vertical apertures extending between said top surface and said bottom surface for enabling the curable material to fill multiple layers of the plurality of foam blocks.

3. An improved stabilization and mounting apparatus as set forth in claim 1, wherein each of said plurality of foam blocks includes a first and a second end surface, a top surface and a bottom surface;

each of said vertical apertures extending between said top surface and said bottom surface for enabling the curable material to fill multiple layers of the plurality of foam blocks; and the curable material filling the vertical apertures of the plurality of foam blocks includes a cementitious material.

4. An improved stabilization and mounting apparatus as set forth in claim 1, wherein each of said mounting strips comprises a wood furring strip.

5. An improved stabilization and mounting apparatus as set forth in claim 1, wherein each of said grooves has a trapezoidal cross-section with a minor base of said trapezoidal cross-section being disposed in alignment with the block surface of each of the plurality of foam blocks.

6. An improved stabilization and mounting apparatus as set forth in claim 1, wherein each of said grooves has a trapezoidal cross-section with a minor base of said trapezoidal cross-section being disposed in alignment with the block surface of each of the plurality of foam blocks;

each of said mounting strips comprising a first and second mounting strip;

said first mounting strip having a triangular cross-section being insertable within said continuous wall grooves; and said second mounting strip having a rhomboidal cross-section being inserted within said continuous wall grooves adjacent to said first mounting strip for substantially filling said continuous wall grooves.

7. An improved stabilization and mounting apparatus as set forth in claim 1, wherein each of said grooves has a trapezoidal cross-section with a minor base of said trapezoidal cross-section being disposed in alignment with the block surface of each of the plurality of foam blocks;

each of said mounting strips comprising a first and second mounting strip;

said first mounting strip having a triangular cross section being insertable within said continuous wall grooves;

said second mounting strip having a rhomboidal cross-section being inserted within said continuous wall grooves adjacent to said first mounting strip for substantially filling said continuous wall grooves; and said fasteners for fixing said triangular cross-section mounting strip to said rhomboidal cross-section mounting strip to interlock said triangular and rhomboidal mounting strips within the continuous wall groove to provide the mounting for attaching the facing material to the wall.

8. An improved stabilization and mounting apparatus as set forth in claim 1, wherein each of said grooves has a trapezoidal cross-section with a minor base of said trapezoidal cross-section being disposed in alignment with the block surface of each of the plurality of foam blocks;

each of said mounting strips comprising a first and second mounting strip;

said first mounting strip having a triangular cross section being insertable within said continuous wall grooves;

said second mounting strip having a rhomboidal cross-section being inserted within said continuous wall grooves adjacent to said first mounting strip for substantially filling said continuous wall grooves;

said fasteners including a mechanical fastener for fixing said triangular cross-section mounting strip to said rhomboidal cross-section mounting strip to interlock said triangular and rhomboidal mounting strips within the continuous wall groove to provide the mounting for attaching the facing material to the wall; and said mechanical fastener extending into the vertical aperture of each of the plurality of foam blocks for being retained by the curable material filled within the vertical aperture of each of the plurality of foam blocks.

9. An improved stabilization and mounting apparatus as set forth in claim 1, wherein said fasteners comprises an adhesive for fixing said mounting strips within said continuous wall grooves.

10. A stabilization and mounting apparatus for stabilizing a wall during the filling and curing thereof and for attaching a facing material to the wall, the wall being constructed from multiple vertically disposed layers of a plurality of foam blocks with each of the plurality of foam blocks having a vertical aperture filled with a curable material, the improvement comprising:

a groove defined in a block surface of each of the plurality of foam blocks;

said grooves in one said vertically disposed layer of the plurality of foam blocks being aligned with said grooves in adjacent said vertically disposed layers of the plurality of foam blocks for providing vertically disposed continuous wall grooves;

a mounting strip located within each of said vertically disposed continuous wall grooves and extending through said multiple vertically disposed layers of the foam blocks;

a plurality of mechanical fasteners securing said mounting strips within said continuous wall grooves for interlocking adjacent said vertically disposed layers of said plurality of foam blocks for stabilizing the wall during the filling of the vertical apertures with the curable material;

said mechanical fasteners extending into the vertical apertures of the foam blocks whereat said mechanical fasteners are encased within and retained by the cured curable material for anchoring said mounting strips to the cured curable material; and, a facing material secured to said mounting strips.

11. A stabilization and mounting apparatus for stabilizing a wall during the filling and curing thereof and for attaching a facing material to the wall, the wall being constructed from multiple vertically disposed layers of a plurality of foam blocks with each of the plurality of foam blocks having a vertical aperture filled with a curable material, the improvement comprising:

a groove defined in a block surface of each of the foam blocks;

each of said grooves having a trapezoidal cross-section with a minor base of said trapezoidal cross-section being disposed in alignment with said block surface of each of the foam blocks;

said grooves in one said vertically disposed layer of the foam blocks being aligned with said grooves in adjacent said vertically disposed layers of the foam blocks for providing vertically disposed continuous wall grooves;

a mounting strip located within each of said vertically disposed continuous wall grooves and extending through said multiple vertically disposed layers of the foam blocks;

each of said mounting strips comprising a first mounting strip having a first cross-section and a second mounting strip having a second cross-section with said first and second mounting strips substantially filling each of said vertically disposed continuous wall grooves;

a plurality of mechanical fasteners interconnecting said first and second mounting strips to impound said first and second mounting strips within said continuous wall grooves;

said mounting strips interlocking adjacent said vertically disposed layers of said foam blocks for stabilizing the wall during the filling of the vertical apertures with the curable material; and said mechanical fasteners extending into the vertical apertures of the foam blocks whereat said mechanical fasteners are encased within and retained by the cured curable material for anchoring said mounting strips to the cured curable material to provide a mounting for attaching the facing material to the wall.

12. A stabilization and mounting apparatus for stabilizing a wall during the filling and curing thereof and for attaching an inner and an outer facing material to the wall, the wall being constructed from multiple vertically disposed layers of a plurality of foam blocks with each of the plurality of foam blocks having an inner and an outer block surface for defining an inner and outer wall surface and having a vertical aperture filled with a curable material, the improvement comprising:

a plurality of outer grooves defined in the outer block surface of each of the plurality of foam blocks;

said plurality of outer grooves being aligned with said plurality of outer grooves in an adjacent said layer for providing a plurality of continuous outer wall grooves;

a plurality of outer mounting strips being inserted within said plurality of continuous outer wall grooves and extending through said multiple vertically disposed layers of the foam blocks;

outer fastening means fixing said plurality of outer mounting strip within said plurality of continuous outer wall grooves for interlocking adjacent said vertically disposed layers of said foam blocks for stabilizing the wall during the filling of the vertical apertures with the curable material and to provide a mounting for attaching the outer facing material to the outer wall;

a plurality of inner grooves defined in the inner block surface of each of the plurality of foam blocks;

said plurality of inner grooves being aligned with said plurality of inner grooves in an adjacent said layer for providing a plurality of continuous inner wall grooves;

a plurality of inner mounting strips being inserted within said plurality of continuous inner wall grooves and extending through said multiple vertically disposed layers of the foam blocks; and inner fastening means fixing said plurality of inner mounting strip within said plurality of continuous inner wall grooves for interlocking adjacent said vertically disposed layers of said foam blocks for stabilizing the wall during the filling of the vertical apertures with the curable material and to provide a mounting for attaching the inner facing material to the inner wall.

13. A method of erecting a wall with a plurality of foam blocks and attaching a facing material to the wall, wherein each of the plurality of foam blocks has an inner and an outer block surface for defining an inner and outer wall surface, each of the plurality of foam blocks having a vertical aperture, the method comprising the steps of:

forming a plurality of grooves defined in one of the inner and the outer block surface of each of the plurality of foam blocks;

stacking the plurality of foam blocks in multiple layers to erect the wall, wherein the plurality of grooves of each layer is aligned to form a plurality of continuous wall grooves;

inserting a plurality of mounting strips within the plurality of continuous wall grooves to extend through multiple vertically disposed said layers of the plurality of foam blocks;

fastening the plurality of mounting strips within the plurality of continuous wall grooves to interlock adjacent said vertically disposed layers of the plurality of foam blocks for stabilizing the wall;

pouring a curable material into the vertical apertures of the plurality of foam block to fill the vertical apertures in the multiple vertically disposed layers of the plurality of foam blocks;

positioning a facing material adjacent to the plurality of mounting strips; and fastening the facing material to the plurality of mounting strips.

14. The method of erecting the wall and attaching the facing material to the wall as set forth in claim 13, wherein the step of forming a plurality of grooves defined in the block surface includes preforming the plurality of grooves in each of the plurality of foam blocks.

15. The method of erecting the wall and attaching the facing material to the wall as set forth in claim 13, wherein the step of forming a plurality of grooves defined in the block surface includes cutting the plurality of grooves in each of the plurality of foam blocks after the plurality of foam blocks are stacked into the wall.

16. The method of erecting the wall and attaching the facing material to the wall as set forth in claim 13, wherein the step of forming a plurality of grooves includes forming a plurality of grooves having a trapezoidal cross-section with a minor base of the trapezoidal cross-section being disposed in alignment with the block surface of each of the plurality of foam blocks.

17. The method of erecting the wall and attaching the facing material to the wall as set forth in claim 13, wherein the step of forming a plurality of grooves includes forming a plurality of grooves having a trapezoidal cross-section with a minor base of the trapezoidal cross-section being disposed in alignment with the block surface of each of the plurality of foam blocks; and, the step of inserting a plurality of mounting strips within the plurality of continuous wall grooves includes inserting a plurality of first mounting strips having a triangular cross section within the plurality of continuous wall grooves and inserting a plurality of second mounting strips having a rhomboidal cross-section within the plurality of continuous wall grooves adjacent to the first mounting strips for substantially filling the plurality of continuous wall grooves.

18. The method of erecting the wall and attaching the facing material to the wall as set forth in claim 13, wherein the step of fastening the plurality of mounting strips within the plurality of continuous wall grooves includes inserting a plurality of mechanical fastener for fixing the mounting strips within the plurality of continuous wall grooves.

19. The method of erecting the wall and attaching the facing material to the wall as set forth in claim 13, wherein the step of fastening the plurality of mounting strips within the plurality of continuous wall grooves includes an adhesive for fixing the plurality of mounting strips within the plurality of continuous wall grooves.

20. A method of erecting a wall with a plurality of foam blocks and attaching a facing material to the wall, wherein each of the plurality of foam blocks has an inner and an outer block surface for defining an inner and outer wall surface, each of the plurality of foam blocks having a vertical aperture, the method comprising the steps of:

forming a plurality of grooves defined in one of the inner and the outer block surface of each of the plurality of foam blocks;

stacking the plurality of foam blocks in multiple layers to erect the wall with the plurality of grooves of each layer being aligned to form a plurality of continuous wall grooves;

inserting a plurality of mounting strips within the plurality of continuous wall grooves to extend through multiple vertically disposed said layers of the plurality of foam blocks;

fastening the plurality of mounting strips within the plurality of continuous wall grooves with mechanical fasteners extending into the vertical aperture of the plurality of foam blocks to interlock adjacent said vertically disposed layers of the plurality of foam blocks for stabilizing the wall;

pouring a curable material into the vertical apertures of the plurality of foam block to fill the vertical apertures in the multiple vertically disposed layers of the plurality of foam blocks and to encase the mechanical fasteners extending into the vertical aperture of the plurality of foam blocks to secure the plurality of mounting strips to the curable material;

positioning a facing material adjacent to the plurality of mounting strips; and fastening the facing material to the plurality of mounting strips.

* * * * *